US005761830A

United States Patent [19]

Condini

[11] Patent Number: 5,761,830

[45] Date of Patent: Jun. 9, 1998

[54] INNER BOOT FOR SKI BOOT

[75] Inventor: Alessandro Condini, Villazzano, Italy

[73] Assignee: Lange International S.A., Switzerland

[21] Appl. No.: 841,117

[22] Filed: Apr. 29, 1997

Related U.S. Application Data

[63] Continuation of Ser. No. 683,160, Jul. 18, 1996, abandoned, which is a continuation of Ser. No. 241,126, May 11, 1994, abandoned.

[30] Foreign Application Priority Data

Jun. 30, 1993 [CH] Switzerland ..... 1965/93

[51] Int. Cl.[6] ..... A43B 5/04; A43B 23/07; A43B 3/10

[52] U.S. Cl. ..... 36/10; 36/99; 36/55; 36/117.6

[58] Field of Search ..... 36/88, 89, 99, 36/105, 109, 10, 45, 55, 71, 117.6; 12/142 R, 142 P

[56] References Cited

U.S. PATENT DOCUMENTS

| | | | |
|---|---|---|---|
| 4,068,337 | 1/1978 | Hanson et al. | 12/142 P |
| 4,499,676 | 2/1985 | Chalmers . | |
| 4,720,926 | 1/1988 | Marxer | 36/117 |
| 4,835,886 | 6/1989 | Chemello et al. | 36/117.8 |
| 4,839,973 | 6/1989 | Dodge | 36/121 |
| 4,972,613 | 11/1990 | Loveder | 36/105 |

FOREIGN PATENT DOCUMENTS

| | | | |
|---|---|---|---|
| 0066133 | 12/1982 | European Pat. Off. . | |
| 66133 | 12/1982 | European Pat. Off. | 36/10 |
| 0107841 | 5/1984 | European Pat. Off. . | |
| 107841 | 5/1984 | European Pat. Off. . | |
| 0086909 | 8/1985 | European Pat. Off. . | |
| 2230155 | 12/1974 | France | 36/119 |
| 3830274 | 3/1989 | Germany . | |
| 9210955 | 7/1992 | WIPO . | |

*Primary Examiner*—M. D. Patterson
*Attorney, Agent, or Firm*—Kane, Dalsimer, Sullivan, Kurucz, Levy, Eisele and Richard, LLP

[57] ABSTRACT

An inner boot has a part (1) which is intended to surround the foot and the heel and has an instep tongue (9). The inner boot has, at the rear, a vertical cut-out whose bottom lies substantially above the calcaneum, in the region of the Achilles tendon, at a height of 8 to 15 cm above the sole of the inner boot. The inner boot preferably has a tongue (8) extending over the cut-out. This inner boot provides good heel support while also making it easy to put a boot on.

3 Claims, 2 Drawing Sheets

INNER BOOT FOR SKI BOOT

This application is a continuation of application Ser. No. 08/683,160, filed Jul. 18, 1996, now abandoned, which was a continuation of Ser. No. 08,241,126 filed May 11, 1996, now abandoned.

FIELD OF THE INVENTION

The subject of the present invention is an inner comfort boot for a ski boot with a boot leg articulated on a shell base, a part of which is intended to surround the foot and the heel and has an instep tongue.

PRIOR ART

Various types of inner comfort boot are known, designed for various types of boots.

Boots comprising a boot leg in the form of a collar articulated on a variable-volume shell base, and fitted with three to five fastening buckles are equipped with an inner boot in the form of a soft ankle-length shoe, cut out at the front and fitted with an instep tongue closing this cut-out. These inner boots surround the foot and the heel as well as the rear and the sides of the ankle in a uniform manner without discontinuity and completely fulfil their function which is to provide comfort and support of the foot and of the ankle. Such inner boots are described, for example, in U.S. Pat. Nos. 4,523,392 and 4,499,676.

The appearance of rear-entry boots, that is to say ones including a boot leg having a rear part which can be tilted backwards in order to make it easier to put the boot on, has led to the use of inner boots in the form of low soft shoes which are slit at the rear from top to bottom, as described in documents EP-A-0,066,133 (U.S. Pat. No. 4,428,130) and EP-A-0,107,841. During skiing, correct support of the heel in the boot is essential for accurate control of the skis. Now, such inner boots, because of the rear slit, do not provide good support of the heel towards the top.

A new type of boot has appeared more recently, making a compromise between rear-entry boots and so-called four-buckle boots. These are the so-called "mid-entry" boots described in U.S. Pat. No. 4,839,973. These boots are equipped with an inner boot comprising an upper part, in the form of a collar, articulated at the level of the malleoli on a lower part surrounding the foot and the heel. Such an inner boot has several drawbacks: the articulation of the two parts requires rivets or other additional means which constitute hard points in a highly sensitive region and which are consequently the source of discomfort and compression which may be painful. The upper articulated part of the inner boot is placed over the lower part just above the heel, in the Achilles tendon region which is also sensitive, creating an overthickness and discontinuity which are also the source of local compressions which may be painful. This superposition cannot be shifted upwards, because the rear tilting of the upper part of the inner boot would no longer be possible. Moreover, this tilting involves stresses, making it necessary for the arc described by the lower edge of the articulated part to match the curvature of the inner boot in the region of the heel as closely as possible. In addition, a space must be left between the shell of the boot and the inner boot in this heel region in order to allow tilting of the upper part of the inner boot. Now, such a space is incompatible with good support of the heel in the boot.

SUMMARY OF THE INVENTION

The object of the present invention is to produce an inner boot which provides comfort and correct support of the heel, like inner boots in the form of a low soft shoe, while providing ease of putting the inner boots into rear-entry and mid-entry boots.

The inner comfort boot according to the invention has, at the rear, a vertical cut-out whose bottom lies substantially above the calcaneum, in the region of the Achilles tendon.

The bottom of the cut-out will generally lie at a height of between 8 and 15 cm above the sole of the boot.

According to a preferred embodiment of the invention, the part intended to surround the heel has a rear tongue extending upward over at least a part of the vertical cut-out.

The tongue provides continuity of the inner boot in the region of the Achilles tendon, whilst being separated therefrom easily when putting on a boot. The inner boot may include, in a manner which is known per se, an independent part in the form of a half-collar, fixed to the boot leg and intended to bear against the bottom of the calf. In the closed position, the independent part of the inner boot is preferably placed over the tongue to create a discontinuity, but this is not uncomfortable because it lies in a part of the lower leg where there is no significant pressure or localized pressing.

According to a preferred embodiment of the invention, the inner boot has regions of greater compressibility in the sensitive region of the malleoli.

BRIEF DESCRIPTION OF THE DRAWING

The attached drawing represents, by way of example, an embodiment of the invention.

DESCRIPTION OF THE PREFERRED EMBODIMENT

Figure 1:
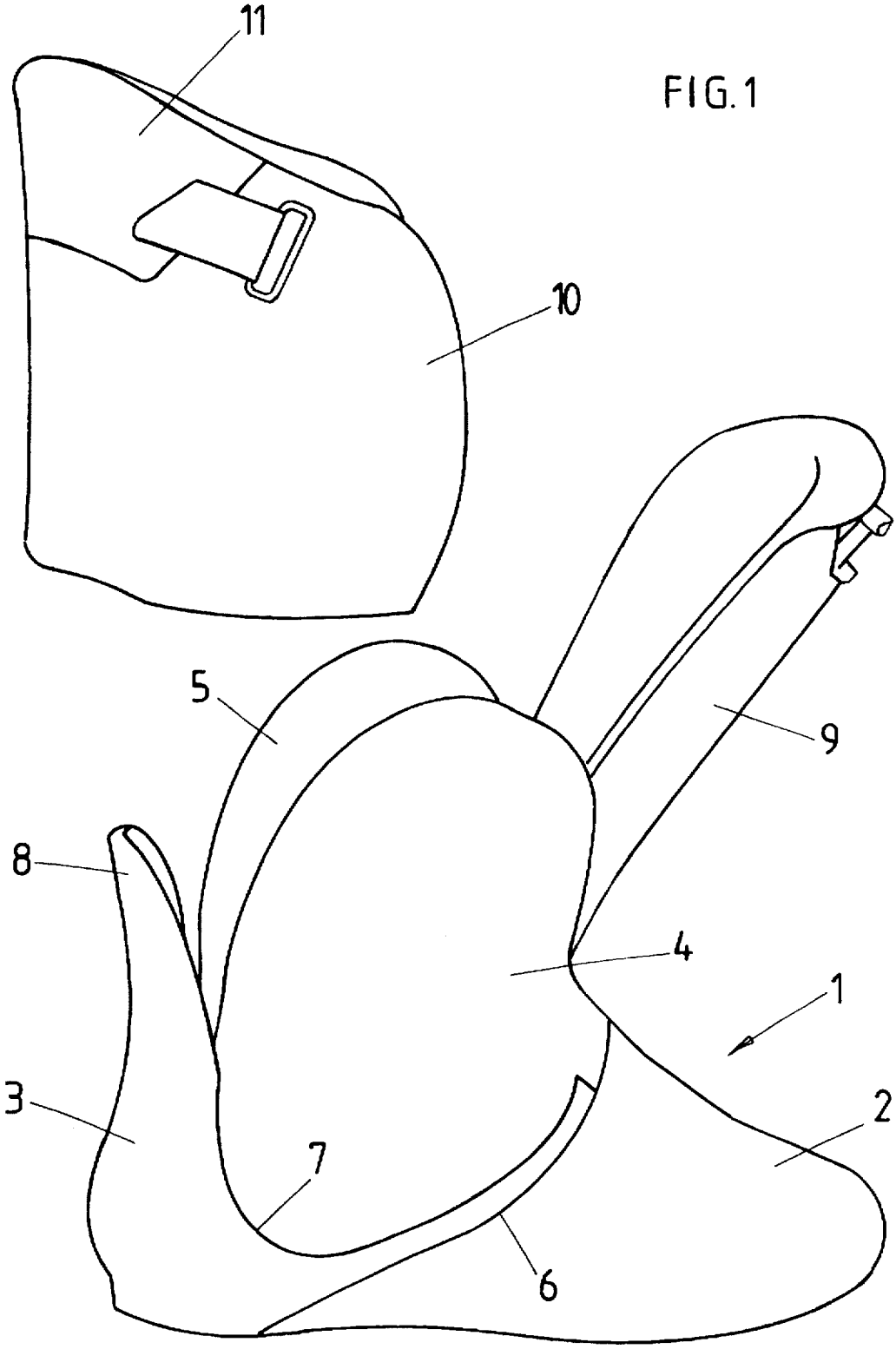
FIG. 1 represents the inner boot.

The inner comfort boot represented in FIG. 1 comprises a part 1 surrounding the foot and the heel. This part 1 consists of panels 2, 3, 4, 5 sewn together, each of these panels consisting, for example, of a synthetic knit adhesively bonded on a panel made of synthetic, preferably cellular material. The seams, such as the seams 7, are such that perfect continuity is ensured between the panels. The panels could be made in any other known manner, for example as described in U.S. Pat. Nos. 5,050,319, 4,893,417 or 4,723,364.

The lower part 1 has, at the rear, a tongue 8 extending the panel 3 and extending above the heel, in the region corresponding to the Achilles tendon, preferably in the region where this tendon connects with the muscle. The tongue 8 extends upward over at least a part of the vertical cut-out 20, whose bottom will generally be at a height of between 8 and 15 cm above the sole of the inner boot and is substantially above the calcaneum, in the region of the Achilles tendon. This tongue 8 can be folded effortlessly toward the rear. At the front, the lower part 1 is fitted with an instep tongue 9. This tongue, of conventional design, is made of semirigid plastic lined with a cushioning on the inside. The seams 7 joining the panels 4 and 5 to the panels 2 and 3 form, on the panel 3, cut-outs freeing the malleoli and the panels 4 and 5 have more cushioning than the panels 2 and 3 so as better to protect the malleoli against the effects of the pressure of the shell on them. The panels 4 and 5 are in the form of side flaps and present regions of greater compressibility in the region of the malleoli.

The inner comfort boot also includes an upper part 10 independent of the lower part 1. This part 10 is in the form of a half-collar. It is made in the same manner as the tongue 9. This part 10 is fitted, in its upper part, with a pocket 11 intended for fastening this part 10 on the leg of the boot, which is fitted into the pocket 11.

Figure 2:
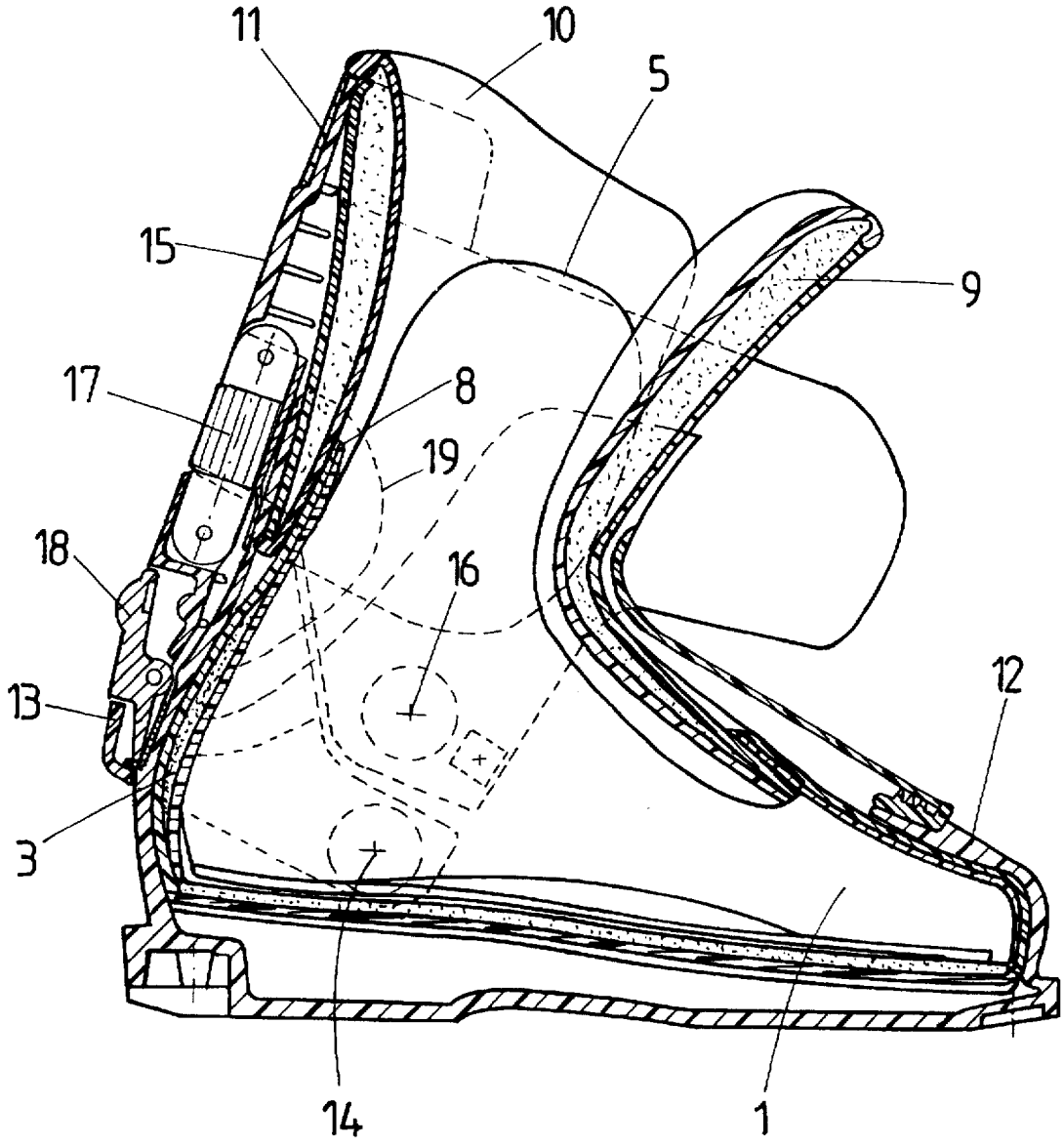
FIG. 2 is a view in longitudinal section of a boot equipped with the inner boot represented in FIG. 1.

FIG. 2 represents a boot of the mid-entry type, equipped with the inner boot represented in FIG. 1. This boot is of the same type as described in U.S. Pat. No. 4,839,973. A shell base 12 is again encountered, on which a lower boot leg part 13 in the shape of a stirrup is articulated around a pin 14, and an upper boot leg part 15, in the form of a collar, is articulated on the shell base 12 about a pin 16 approximately corresponding to the position occupied by the malleoli. The parts 15 and 13 are joined by a connecting rod 17. In addition, a clip 18 mounted on the stirrup 13 and intended to lock the leg of the boot in the downhill skiing position is again found.

The drawing shows that the lower part 1 of the inner boot perfectly surrounds the heel, without discontinuity, and also well above the heel, this being essential for supporting the heel in the vertical direction. The rear part 3 also bears uniformly against the inner wall of the shell. This bearing ensures holding of the heel without creating localized pressure regions. The tongue 8 ensures continuity with the upper part 10 of the inner boot, the pocket 11 of which is seen in FIG. 2 fitted onto the collar 15.

For putting on and taking off a boot, the collar 15 and the stirrup 13 are tilted backward. The flexibility of the tongue 8 makes it possible to introduce the foot into the inner boot or withdraw it with ease.

It will be noted that the cushioning of the upper part 10 of the inner boot is interposed between the tongue 19 of the shell base 1 and the tongue 8 of the inner boot, so that the wearer has the impression that the tongue 8 is itself cushioned.

The invention is not limited to the embodiment described hereinabove. According to another embodiment, the piece 10 passes in front of the tongue 8 of the inner boot in such a way that the tongue is drawn backward by the piece 10 when the leg of the boot is opened. According to another embodiment, the tongue 8 could be dispensed with. According to another embodiment, the tongue 8 and the lateral parts 4 and 5 could extend up to the top of the boot leg so that the independent part 10 may be omitted, this part being essentially replaced by the tongue which is, in this case, provided with means of fastening to the back part of the boot leg.

I claim:

1. An inner comfort boot for a ski boot with a boot leg collar articulated on a shell base, comprising a lower part element entirely containable in the boot and adapted to surround the foot and the heel of a skier and having a sole and a rear upper part element independent and separated from the lower part element and provided with fastening means for fastening to the boot leg, and said lower part element having an instep tongue, said lower part element having, at the rear, opposed vertical cut-outs having a bottom and forming a rear tongue, said lower part element having two side panels distinct from the inset tongue and the rear tongue, the bottom of the cut-outs being at a height of 8 to 15 cm above the sole of the lower part element.

2. The inner comfort boot as claimed in claim 1, wherein the inner boot has regions (4, 5) of greater compressibility in the region of the malleoli.

3. The inner comfort boot as claimed in claim 2, wherein the regions (4, 5) of greater compressibility form side flaps extending towards the top of the inner boot.

* * * * *

UNITED STATES PATENT AND TRADEMARK OFFICE

CERTIFICATE OF CORRECTION

PATENT NO. : 5,761,830

DATED : Jun. 9, 1998

INVENTOR(S) : Alessandro Condini

It is certified that error appears in the above-identified patent and that said Letters Patent is hereby corrected as shown below:

Column 4, line 24, change "inset" to --instep--.

Signed and Sealed this

Sixth Day of October, 1998

*Attest:*

*Attesting Officer*

BRUCE LEHMAN

*Commissioner of Patents and Trademarks*